US009341008B1

(12) United States Patent
Amerling et al.

(10) Patent No.: US 9,341,008 B1
(45) Date of Patent: May 17, 2016

(54) HINGE ASSEMBLIES FOR A COWL OF AN OUTBOARD MOTOR

(71) Applicant: Brunswick Corporation, Lake Forest, IL (US)

(72) Inventors: Steven J. Amerling, Fond du Lac, WI (US); Brad J. Van Ruiswyk, Waupun, WI (US); David B. Griep, Rubicon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/554,192

(22) Filed: Nov. 26, 2014

(51) Int. Cl.
*B63H 20/32* (2006.01)
*B63H 21/36* (2006.01)
*E05D 1/04* (2006.01)

(52) U.S. Cl.
CPC ..... *E05D 1/04* (2013.01)

(58) Field of Classification Search
CPC ..... B63H 20/32
USPC ..... 440/77
See application file for complete search history.

(56) References Cited

U.S. PATENT DOCUMENTS 4,050,359 A 9/1977 Mayer
4,348,194 A * 9/1982 Walsh ..... F02B 61/045 123/195 P
4,600,396 A * 7/1986 Crane ..... F02B 61/045 292/247
4,615,683 A 10/1986 Harada et al.
4,872,857 A 10/1989 Newman et al.
4,893,800 A 1/1990 Tabata
5,052,961 A 10/1991 Uchida et al.
5,707,263 A 1/1998 Eick et al.
5,996,745 A 12/1999 Jones, Jr. et al.
6,176,170 B1 1/2001 Uppgard et al.
6,183,321 B1 2/2001 Alby et al.
6,273,771 B1 8/2001 Buckley et al.
6,322,404 B1 11/2001 Magee et al.
6,419,534 B1 7/2002 Helsel et al.
6,663,450 B1 * 12/2003 Walczak ..... F02B 61/045 123/195 P
6,682,379 B1 * 1/2004 Walczak ..... B63H 20/32 123/195 P (Continued)

FOREIGN PATENT DOCUMENTS

EP 1 803 961 2/2011
EP 2 113 681 10/2011
WO 96/33356 10/1996

OTHER PUBLICATIONS

Unpublished U.S. Appl. No. 14/594,228, filed Jan. 12, 2015.

(Continued)

*Primary Examiner* — Daniel V Venne
(74) *Attorney, Agent, or Firm* — Andrus Intellectual Property Lwa, LLP

(57) ABSTRACT

A hinge assembly is for a cowl of an outboard motor. The hinge assembly is configured to connect a first portion of the cowl to a second portion of the cowl. The hinge assembly comprises an arm that is connected to one of the first and second cowl portions and a retainer that is connected to the other of the first and second cowl portions. The arm is movable with respect to the retainer between a registered position wherein the arm is retained by and pivotable with respect to the retainer to thereby pivotably connect the first portion of the cowl to the second portion of the cowl and an unregistered position wherein the arm is separated from the retainer so that the first portion of the cowl is separated from the second portion of the cowl.

22 Claims, 7 Drawing Sheets

(56) References Cited

U.S. PATENT DOCUMENTS

| | | | | |
|---|---|---|---|---|
| 6,830,492 | B1 | 12/2004 | Magee et al. | |
| 6,929,518 | B1 | 8/2005 | Sawyer et al. | |
| 6,942,530 | B1 | 9/2005 | Hall et al. | |
| 6,991,500 | B1 * | 1/2006 | Gulko | F02B 61/045 123/195 P |
| 7,156,709 | B1 | 1/2007 | Staerzl et al. | |
| 7,244,152 | B1 | 7/2007 | Uppgard | |
| 7,267,592 | B1 * | 9/2007 | Ingebritson | B63H 20/32 123/195 P |
| 7,896,304 | B1 | 3/2011 | Eichinger et al. | |
| 7,942,711 | B1 | 5/2011 | Swan | |
| 8,113,892 | B1 | 2/2012 | Gable et al. | |
| 2003/0232548 | A1 * | 12/2003 | Alby | F02B 61/045 440/77 |
| 2009/0276098 | A1 | 11/2009 | Bodie et al. | |

OTHER PUBLICATIONS

Unpublished U.S. Appl. No. 13/688,109, filed Nov. 28. 2012.

* cited by examiner

HINGE ASSEMBLIES FOR A COWL OF AN OUTBOARD MOTOR

FIELD

The present disclosure generally relates to outboard motors and more specifically to hinge assemblies for cowls of outboard motors.

BACKGROUND

U.S. Pat. No. 4,615,683 discloses an outboard motor arrangement and more particularly a power head construction embodying a hinged cover member that is pivotal to offer access to the engine for servicing without necessitating its removal. In addition, an elastomeric support is provided for the engine that minimizes the transmission of vibrations from the engine to the associated watercraft.

U.S. Pat. No. 5,052,961 discloses six embodiments of a cowling assembly for a powerhead of an outboard motor which include a top cover divided into a center cowling member, and removable front and rear cowling members, or alternatively, two removable side cowling members.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter. In certain examples disclosed herein, a hinge assembly is for a cowl of an outboard motor. The hinge assembly is configured to connect a first portion of the cowl to a second portion of the cowl. The hinge assembly can comprise an arm that is connected to one of the first and second cowl portions and a retainer that is connected to the other of the first and second cowl portions. The arm is movable with respect to the retainer between a registered position wherein the arm is retained by and is pivotable with respect to the retainer to thereby pivotably connect the first portion of the cowl and the second portion of the cowl, and an unregistered position wherein the arm is separated from the retainer so that the first portion of the cowl is separated from the second portion of the cowl.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
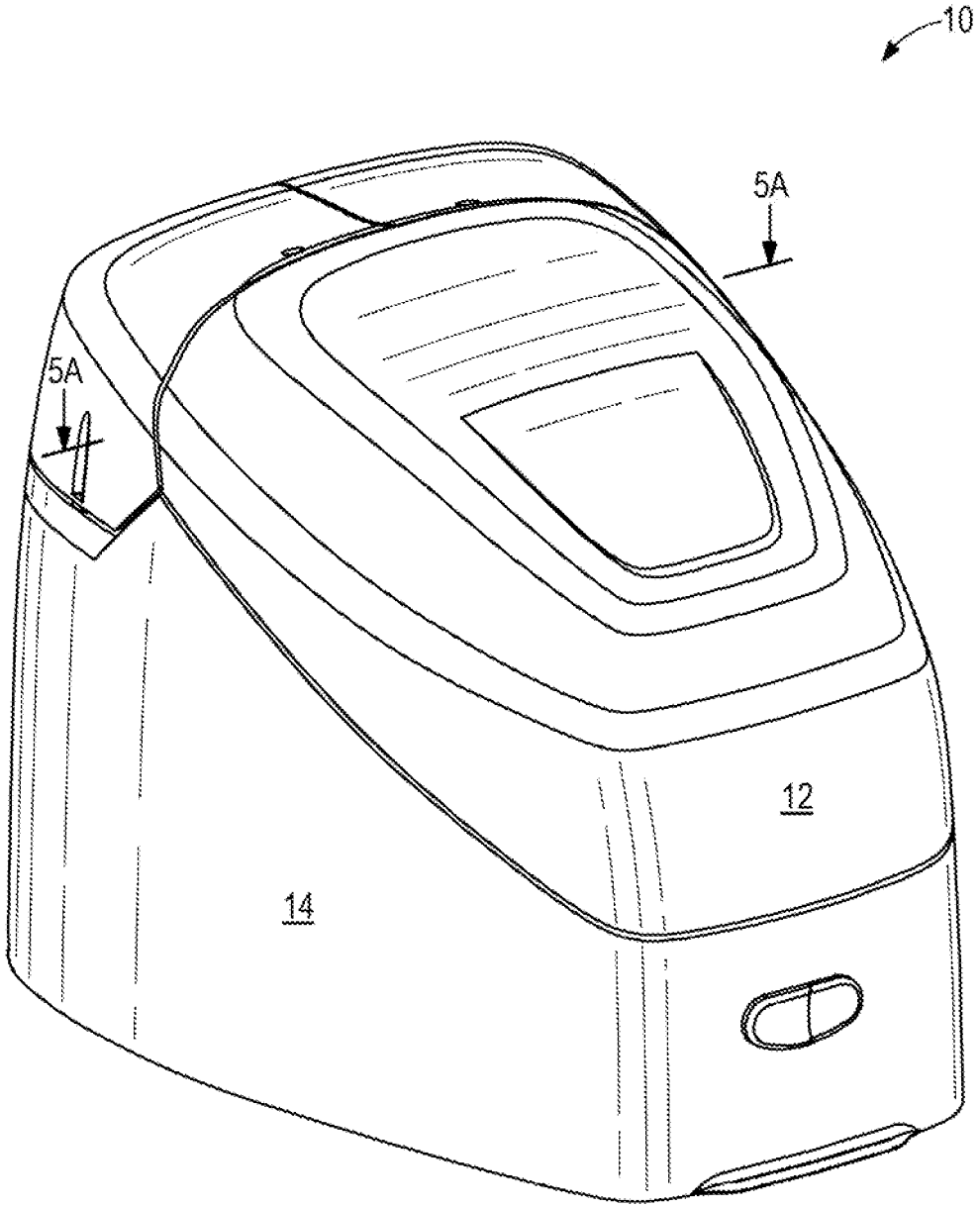
FIG. 1 is a perspective view of a cowl for an outboard motor, the cowl having first and second portions, showing the first portion in a registered, closed cowl position.

Through research and experimentation, the present inventors have determined that simple outboard motor maintenance and daily engine system checks require removal of the top cowl to expose the engine. As the engine horsepower increases, the weight and size of the top cowl increases, thus making the top cowl difficult to lift and/or handle. Also, some boat applications, for example poling platforms, may not allow the top cowl to be fully opened. The present disclosure addresses these drawbacks that are found in the prior art.

FIGS. 1-6 depict a cowl 10 for an outboard motor. The cowl 10 has a first portion 12 that is pivotably connected to a second portion 14. In this example the first portion 12 is a top portion and the second portion 14 is a bottom portion; however the first and second portions 12, 14 can be side portions or bottom and top portions, respectively. As shown in FIGS. 2-5, a pair of hinge assemblies 16*a*, 16*b* are located at one end of the first and second portions 12, 14 and are configured to pivotably and releasably connect the first portion 12 and the second portion 14 together. The hinge assemblies 16*a*, 16*b* are mirror opposites of each other and therefore discussion herein below regarding "a hinge assembly" equally applies to both hinge assemblies 16*a*, 16*b*. Each hinge assembly 16*a*, 16*b* has an arm 18 that is fixedly connected to the first portion 12 of the cowl 10 and a retainer 20 that is fixedly connected to the second portion 14 of the cowl 10. In this example, the arm 18 is made of plastic and is formed as one piece with the first portion 12; however this can vary. For example, the arm 18 could be made of a material other than plastic, and the arm 18 does not have to be formed with the first portion 12. The retainer 20 also is formed of plastic and is fixed to a center mount 22 (see FIG. 2) on the second portion 14 of the cowl 10 by bolts 24. The bolts 24 are secured to the center mount 22 via brackets 26. The center mount 22 in turn is secured to the second portion 14 of the cowl 10. This can also vary. In other examples, the retainer 20 could be directly connected to or formed with the second portion 14. The retainer 20 can be made of a material other than plastic.

Figure 2:
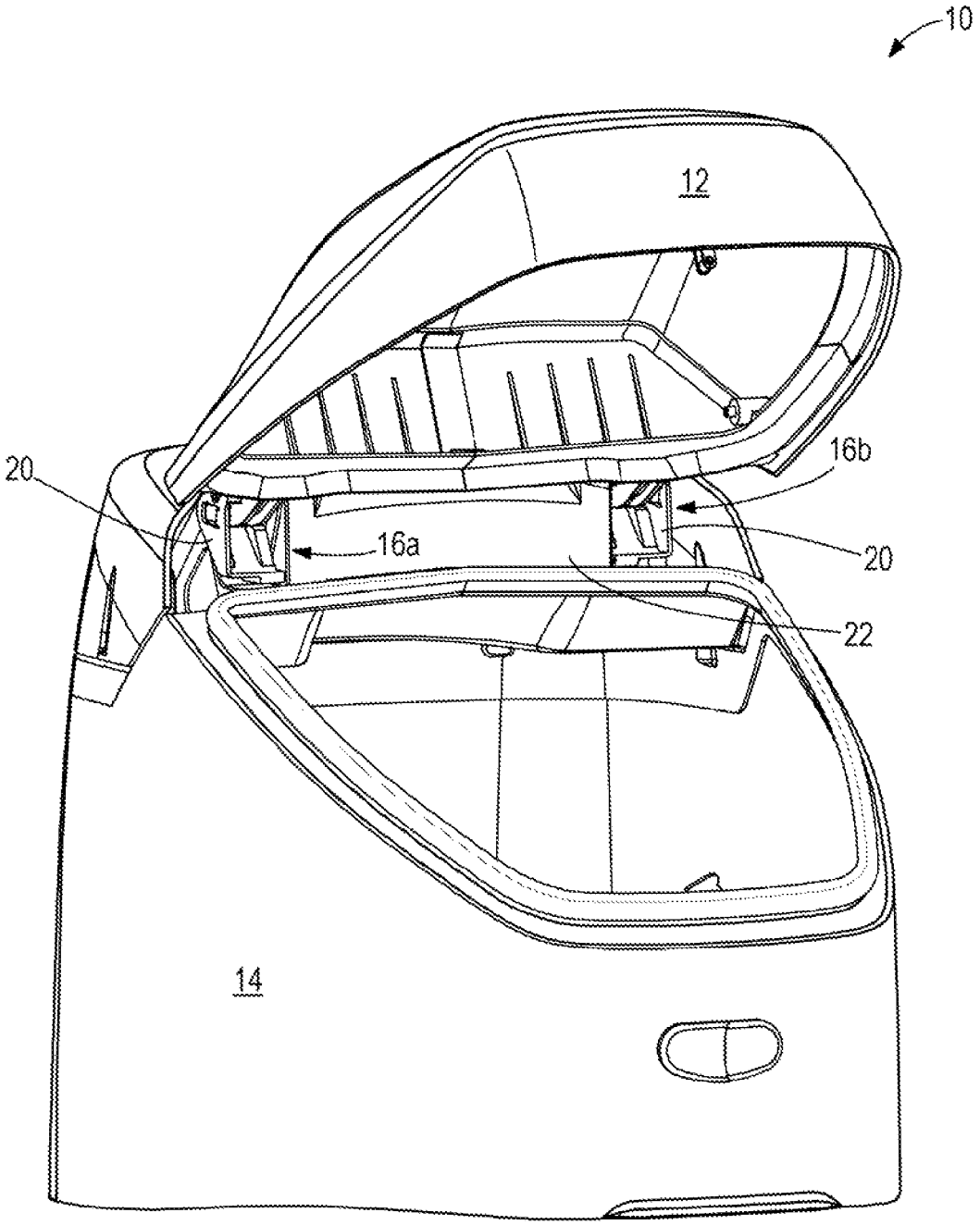
FIG. 2 is a perspective view of the cowl, showing the first portion in a registered, open cowl position.
Figure 3:
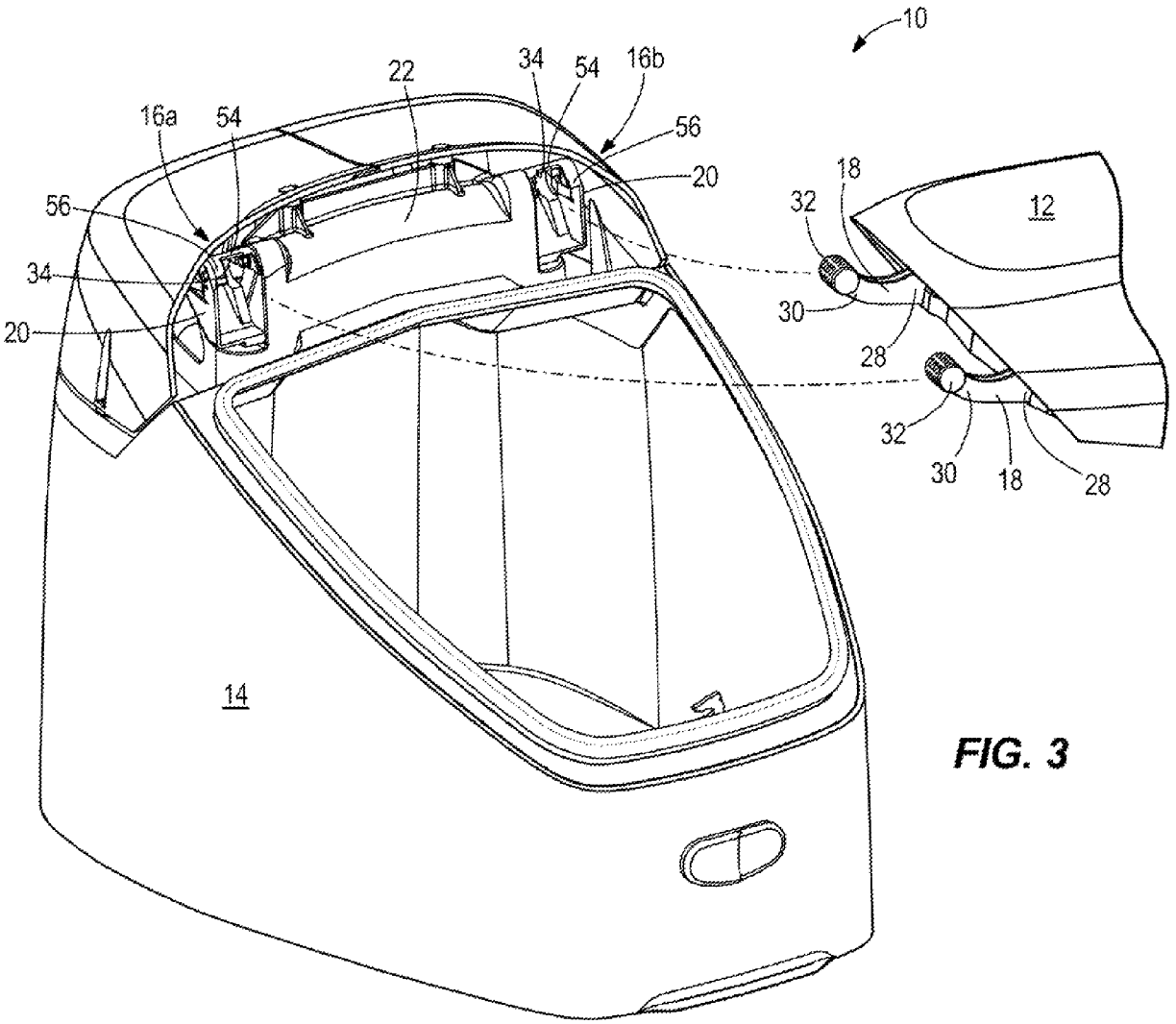
FIG. 3 is a perspective, view of the cowl, showing the first portion in an unregistered position.

As shown by comparing FIGS. 2 and 3, the arm 18 is movable with respect to the retainer 20 between a registered position (FIG. 2) wherein the arm 18 is retained by and pivotable with respect to the retainer 20 to thereby pivotably connect the first portion 12 of the cowl 10 to the second portion 14 of the cowl 10, and an unregistered position (FIG. 3) wherein the arm 18 is separated from the retainer 20 so that the first portion 12 of the cowl 10 is separated from the second portion 14 of the cowl 10. The arm 18 includes a first end 28 that is connected to the first portion 12 of the cowl 10 and an opposite, second end 30 that is retained by and pivotable with respect to the retainer 20. A body 32 is disposed on and extends transversely to the second end 30 of the arm 18. In this example, the body 32 is cylindrical, is made of plastic, and is formed with the arm 18; however this can vary. The body 32 does not necessarily have to be cylindrical, it could be formed of a material other than plastic, and it could be formed separately from the arm 18. The retainer 20 defines a complementary recess 34 that is sized and shaped to receive the body 32 and permit pivoting of the first portion 12 including the body 32 and arm 18 with respect to the retainer 20 between a closed cowl position (FIG. 1) and an open cowl position (FIG. 2). In this example, the recess 34 is cylindrically shaped; however the shape and size of the recess 34 can vary depending upon the shape and size of the body 32.

Figure 5A:
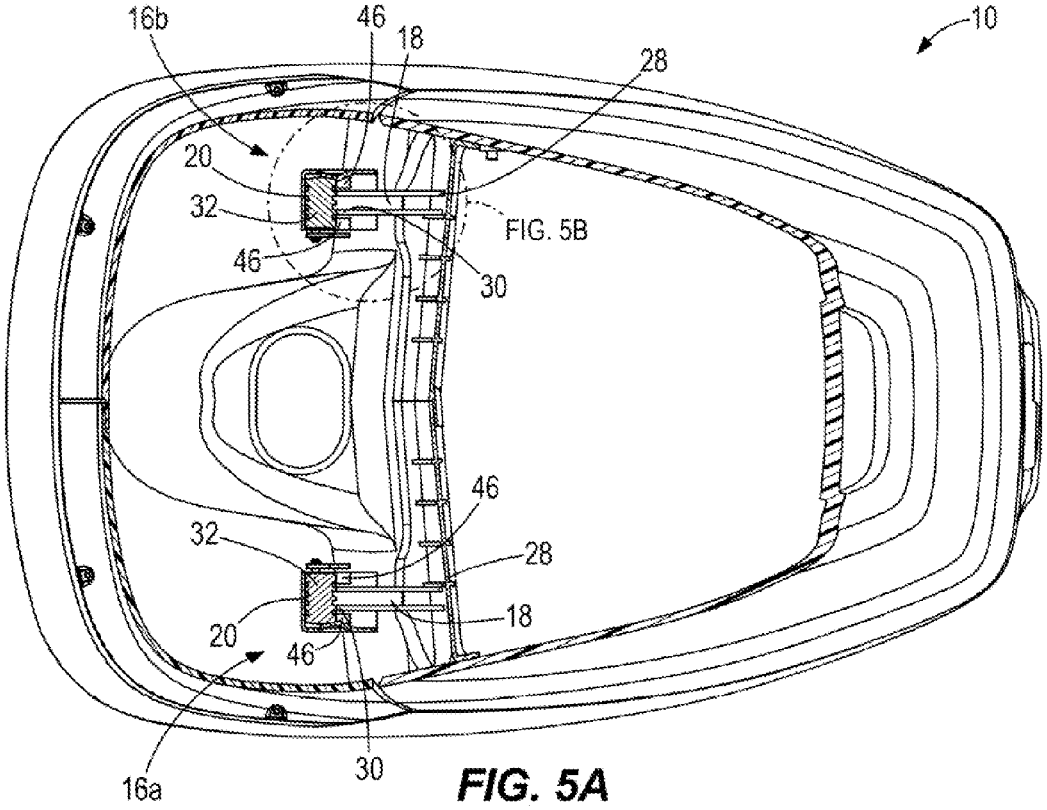
FIG. 5A is a view of section 5A-5A in FIG. 1.
Figure 5B:
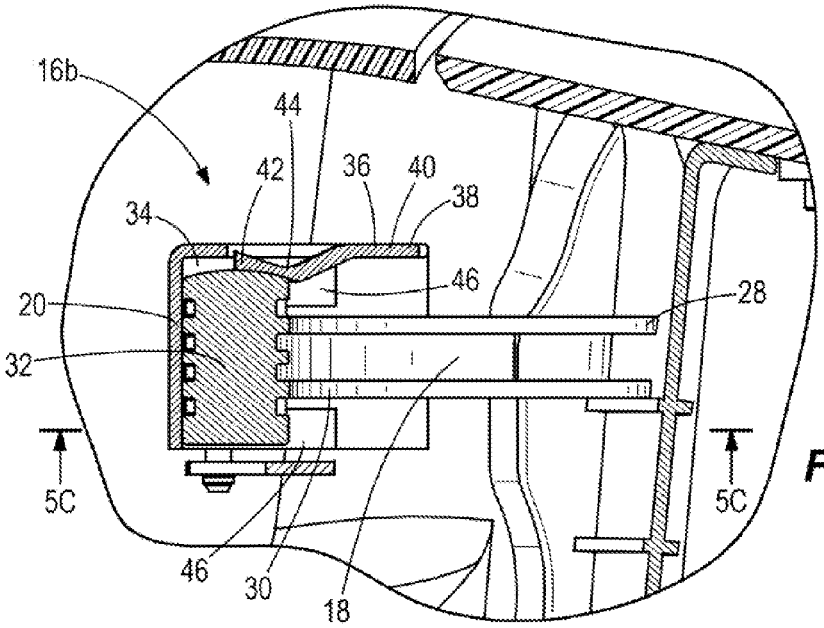
FIG. 5B is a view of section 5B-5B in FIG. 5A.

The retainer 20 has a flexible member 36 that is configured to retain the body 32 in the recess 34 in the registered position (FIGS. 1 and 2). The flexible member 36 is resilient and is forced outwardly by the body 32 as the body 32 is inserted into the recess 34. The flexible member 36 springs back inwardly into the recess 34 once the body 32 enters the recess 34. In this position, the flexible member 36 helps retain the body 32 in the recess 34. Referring, to FIG. 5B, the retainer 20 includes a sidewall 38 and the flexible member 36 is formed with the sidewall 38. The flexible member 36 has a first end 40 that is formed with or connected to the sidewall 38, a second end 42 that is free from the sidewall 38, and a middle portion 44 that is located between the first and second ends 40, 42. The middle portion 44 is bent so as to protrude into the recess 34. When the arm 18 is in the registered position, it is pivotable with respect to the retainer 20 through a range of pivot motion between a closed cowl position (FIG. 1) and an open cowl position (FIG. 2).

Figure 5C:
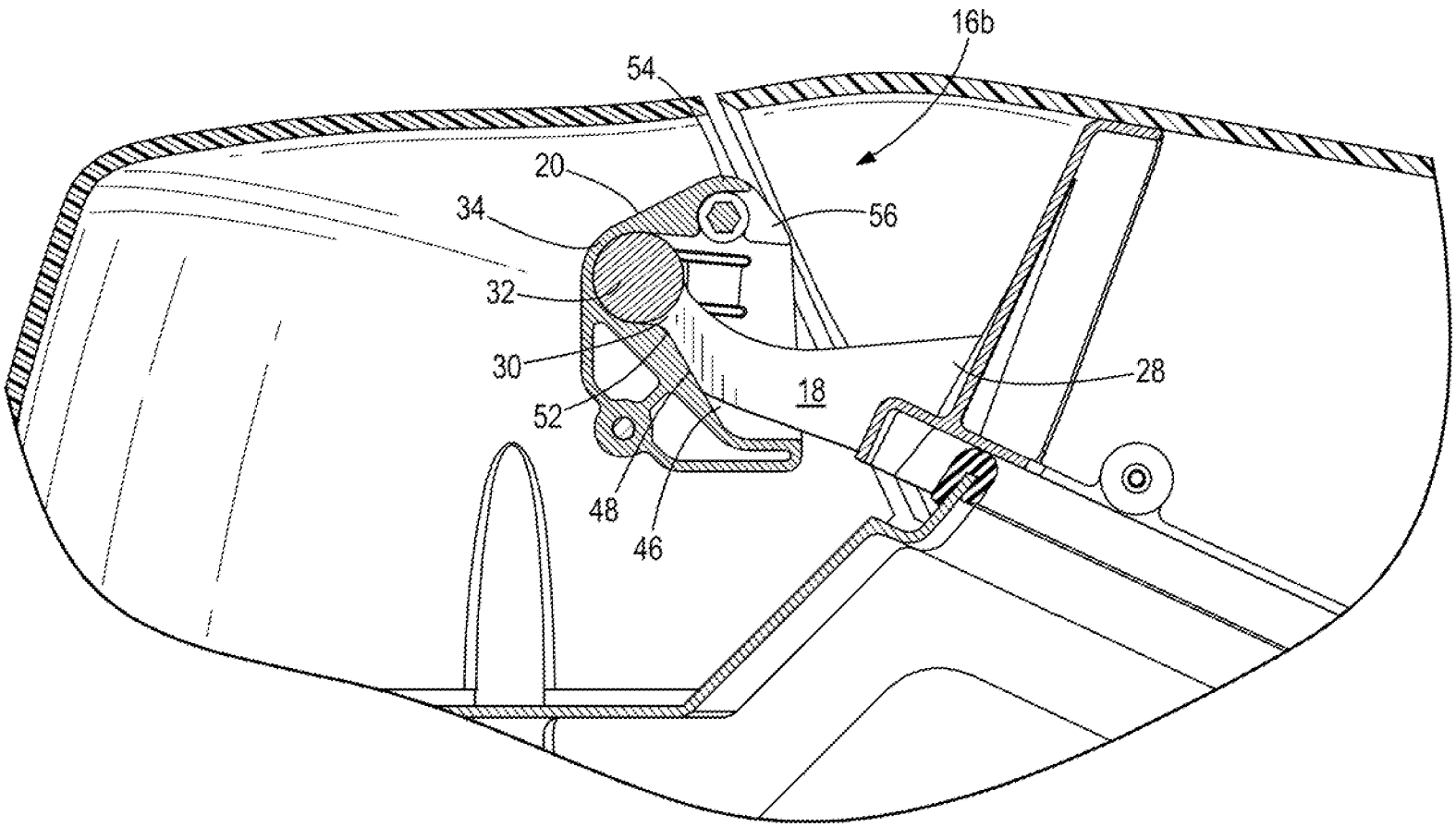
FIG. 5C is a view of section 5C-5C in FIG. 5B.

The retainer 20 includes a pair of ramps 46 that are configured to guide movement of the body 32 into and out of the recess 34 when the first portion 12 is moved into and out of the registered position. Referring to FIG. 5C, each ramp 46 includes a sloped surface 48 and a crest 52 at the top of the sloped surface 48. The body 32 on the arm 18 is configured to engage with and slide along the sloped surfaces 48 of the ramps 46 and over the crest 52 and into the recess 34 as the arm 18 is moved into the registered position.

Figure 4:
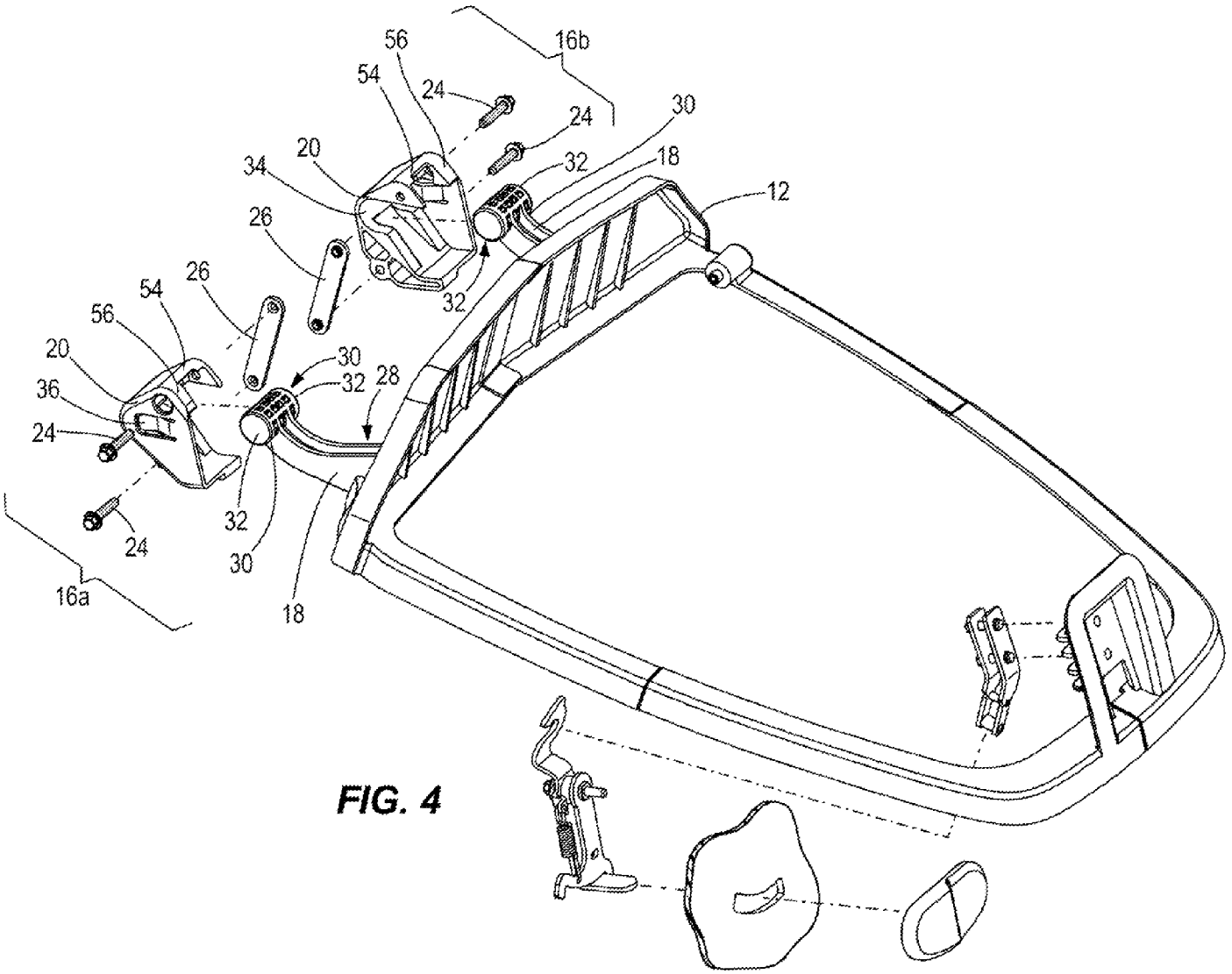
FIG. 4 is an exploded view of portions of the cowl.

Referring to FIGS. 4 and 5C, the retainer 20 also includes an upper retaining wall 54 that is configured to engage with the arm 18 when the arm 18 is pivoted into the open cowl position (FIG. 2). When the arm 18 engages with the retaining wall 54, the body 32 engages with the crest 52 so that over-rotation of the arm 18 with respect to the retainer 20 is prevented. That is, the crest 52 engages with the body 32 when the arm 18 is pivoted into the open cowl position (FIG. 2), such that the retaining wall 54 and crest 52 together prevent further pivoting movement of the arm 18 past the open cowl position shown in FIG. 2.

The retaining wall 54 also includes a flange 56 that extends downwardly towards the ramps 46 along side of the arm 18. The flange 56 is configured to engage with the body 32 and prevent the body 32 from moving out of the recess 34 (into the unregistered position) when the arm 18 is in the open cowl position. The flange 56 is sized so that it does not prevent movement of the body 32 into and out of the recess 34 when the arm 18 is not in the open cowl position. In other words, the first portion 12 cannot move from the registered, open position (FIG. 2) to the unregistered position (FIG. 3) unless the first portion 12 has been pivoted towards the closed position (FIG. 1) to a position where the body 32 clears the flange 56.

Figure 6:
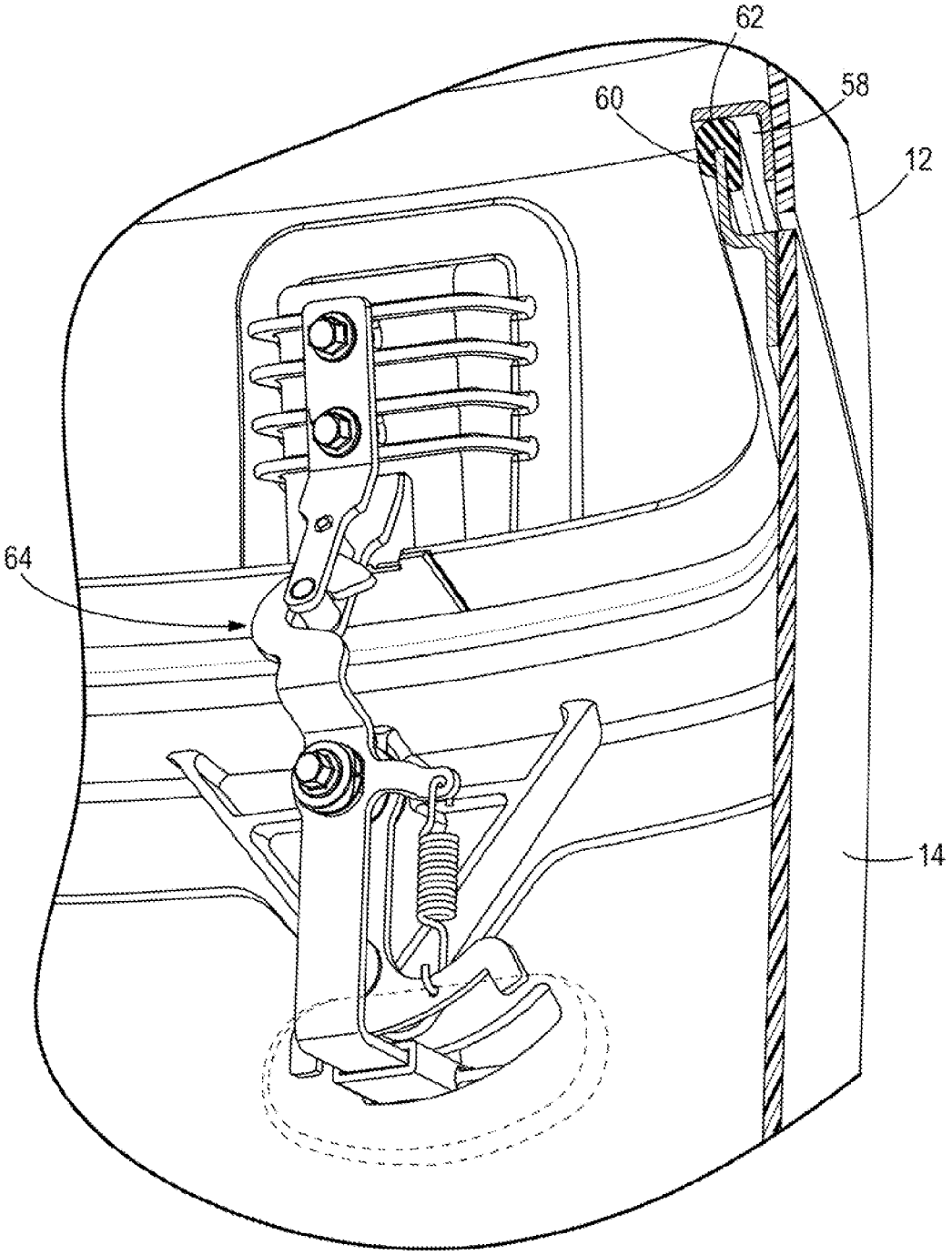
FIG. 6 is an exemplary front latch on the cowl.

Referring, to FIG. 6, the first portion 12 of the cowl 10 has a perimeteral surface 58 that faces an upper perimeteral edge 60 on the second portion 14 of the cowl 10 when the first portion 12 of the cowl 10 is in the closed cowl position (FIG. 1). A perimeteral seal 62 is provided on the upper perimeteral edge 60 for preventing passage of water between the first portion 12 and second portion 14 when the first portion 12 is in the noted closed cowl position (FIG. 1). In other examples, the perimeteral seal 62 could also or alternatively be provided on the perimeteral surface 58. One example a suitable seal is a rubber gasket; however the type and configuration of the seal can vary.

A latch 64 is provided at a second, opposite end of the first and second portions 12, 14 of the cowl 10 to selectively latch the first portion 12 of the cowl 10 in the noted closed cowl position. The latch 64 can be any conventional latch, one example of which is shown in FIG. 6. The configuration of the latch 64 can vary from that which is shown. Further description of the latch 64 is thus not provided herein for brevity sake. Optionally, a device can be added for holding the first portion 12 of the cowl 10 in the open cowl position shown in FIG. 2. Such devices are commonly utilized in automobile hood arrangements and can include a gas spring or other similar means for holding the first portion 12 into the open cowl position.

As shown in FIGS. 1-3, the first portion 12 of the cowl 10 is pivotable with respect to the second portion 14 of the cowl 10, thus allowing the operator to access the engine. The hinge assemblies 16*a*, 16*b* and first and second portions 12, 14 and the latch 64 can be configured such that first portion 12 of the cowl 10 is preloaded with respect to the second portion 14 of the cowl 10 when the first portion 12 is pivoted into the closed cowl position and the latch 64 is secured. More specifically, the hinge assemblies 16*a*, 16*b* and the latch 64 can be oriented and sized with respect to each other such that downward force from latching of the latch 64 forces the arm 18 and body 32 to rock upwardly against the retainer 20. This creates torque pressure on the first portion 12, and hence the perimeteral seal 62, enhancing its watertight characteristic. If the operator desires to completely remove the first portion 12 of the cowl 10, the first portion 12 can be partially opened to a location between the locations shown in FIGS. 1 and 2, and then pulled laterally away from the second portion 14, as shown in FIG. 3. The body 32 pushes the flexible member 36 outwardly and the body 32 is freed to move out away from the recess 34. Once the body 32 is past the middle portion 44 of the flexible member 36, the flexible member 36 springs back into its original position. To re-install the first portion 12 of the cowl 10, the operator pushes the body 32 laterally into the recess 34, deflecting the flexible member 36 until the body 32 is fully seated in the recess 34. The flexible member 36 then springs back inwardly into the recess 34 and re-engages with the body 32 to thereby help retain the first portion 12 with respect to the second portion 14. The present embodiments thus provide a cowl cover that is allowed to both hinge with respect to the cowl body and be easily removed therefrom.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A hinge assembly for a cowl of an outboard motor, the hinge assembly being configured to pivotably and releasably connect a first portion of the cowl to a second portion of the cowl, the hinge assembly comprising:

an arm that is configured to connect to one of the first and second cowl portions and a retainer that is configured to connect to another of the first and second cowl portions, wherein the arm is movable with respect to the retainer between a registered position in which the arm is retained by and pivotable with respect to the retainer to thereby pivotably connect the first portion of the cowl to the second portion of the cowl and an unregistered position in which the arm is separated from the retainer so that the first portion of the cowl is separated from the second portion of the cowl;

wherein the arm comprises a first end that is configured to connect to the first portion of the cowl and an opposite, second end that is configured to be pivotably retained by the retainer; and a body that is disposed on and extends transversely to the second end of the arm, wherein the retainer comprises a complementary recess that is configured to receive the body and permit pivoting of the arm with respect to the retainer.

2. The hinge assembly according to claim 1, wherein the retainer comprises a flexible member that is configured to retain the arm in the retainer.

3. The hinge assembly according to claim 2, wherein the retainer comprises a side wall, and wherein the flexible member has a first end that is connected to the side wall, a second end that is freely movable with respect to the sidewall, and a middle portion that is disposed between the first end and the second end, wherein the middle portion extends into the retainer.

4. The hinge assembly according to claim 1, further comprising a flexible member that is configured to retain the body in the recess, wherein the flexible member bends outwardly as the body is inserted into the recess and then springs back inwardly as the body is fully seated in the recess to thereby retain the body in the recess.

5. The hinge assembly according to claim 1, wherein when the arm is in the registered position, the arm is pivotable with respect to the retainer through a range of pivot motion between an open cowl position and a closed cowl position.

6. The hinge assembly according to claim 5, wherein the retainer comprises at least one ramp that is configured to guide movement of the body into and out of the recess.

7. The hinge assembly according to claim 6, wherein the at least one ramp comprises a sloped surface and a crest on top of the sloped surface, and wherein the body is configured to engage with and slide along the sloped surface and over the crest as the arm is moved into the registered position.

8. The hinge assembly according to claim 7, wherein the retainer comprises at least one retaining wall that engages with the arm when the arm is pivoted into the open cowl position, and further wherein the crest engages with the body when the arm is pivoted into the open cowl position, such that the retaining wall and crest together prevent further pivoting movement of the arm past the open cowl position.

9. The hinge assembly according to claim 8, wherein the retaining wall and crest further prevent movement of the arm out of the recess into the unregistered position when the arm is in the open cowl position.

10. The hinge assembly according to claim 9, wherein the retaining wall includes a flange that extends downwardly towards the at least one ramp, and wherein the flange engages with the body to further prevent movement of the arm out of the recess into the unregistered position when the arm is in the open cowl position.

11. A cowl for an outboard motor, the cowl comprising first and second portions and a hinge assembly that connects the first and second portions together, the hinge assembly comprising:

an arm connected to one of the first and second cowl portions and a retainer connected to another of the first and second cowl portions; wherein the arm is movable with respect to the retainer between a registered position in which the arm is retained by and pivotable with respect to the retainer, thereby pivotably connecting the first portion of the cowl to the second portion of the cowl, and an unregistered position in which the arm is separated from the retainer so that the first portion of the cowl is separated from the second portion of the cowl;

wherein the arm comprises a first end that is configured to connect to the first portion of the cowl and an opposite, second end that is configured to be pivotably retained by the retainer; and a body that is disposed on and extends transversely to the second end of the arm, wherein the retainer comprises a complementary recess that is configured to receive the body and permit pivoting of the arm with respect to the retainer.

12. The cowl according to claim 11, wherein the retainer comprises a flexible member that is configured to retain the arm in the retainer.

13. The cowl according to claim 12, wherein the retainer comprises a side wall, wherein the flexible member is formed in the side wall, and wherein the flexible member has a first end that is connected to the side wall, a second end that is freely movable with respect to the sidewall, and a middle portion that is disposed between the first end and the second end, wherein the middle portion bends inwardly into the retainer.

14. The cowl according to claim 11, further comprising a flexible member that is configured to retain the body in the recess, wherein the flexible member bends outwardly as the body is inserted into the recess and then springs back inwardly as the body is fully seated in the recess to thereby retain the body in the recess.

15. The cowl according to claim 11, wherein when the arm is in the registered position, the arm is pivotable with respect to the retainer through a range of pivot motion between an open cowl position and a closed cowl position.

16. The cowl according to claim 15, wherein the retainer comprises at least one ramp that is configured to guide movement of the body into and out of the recess.

17. The cowl according to claim 16, wherein the at least one ramp comprises a sloped surface and a crest on top of the sloped surface, and wherein the body is configured to engage with and slide along the sloped surface and over the crest as the arm is moved into the registered position.

18. The cowl according to claim 17, wherein the retainer comprises at least one retaining wall that engages with the arm when the arm is pivoted into the open cowl position, and further wherein the crest engages with the body when the arm is pivoted into the open cowl position, such that the retaining wall and crest together prevent further pivoting movement of the arm past the open cowl position.

19. The cowl according to claim 18, wherein the retaining wall and crest further prevent movement of the arm out of the recess into the unregistered position when the arm is in the open cowl position.

20. The cowl according to claim 19, wherein the retaining wall includes a flange that extends downwardly towards the at least one ramp, and wherein the flange engages with the body to further prevent movement of the arm out of the recess into the unregistered position when the arm is in the open cowl position.

21. The cowl according to claim 11, wherein the hinge assembly is one of a pair of hinge assemblies that are mirror opposites of each other and are located on one end of the first and second portions of the cowl.

22. The cowl according to claim 21, comprising a latch connecting a second, opposite end of the first and second portions of the cowl together in the closed cowl position.

* * * * *